US005660111A

United States Patent [19]

Herbert

[11] Patent Number: 5,660,111

[45] Date of Patent: Aug. 26, 1997

[54] FRANKING MACHINE AND METHOD OF IDENTIFYING FRANKING MACHINE

[75] Inventor: Raymond John Herbert, Leigh-on-Sea, United Kingdom

[73] Assignee: Neopost Limited, Essex, United Kingdom

[21] Appl. No.: 591,699

[22] Filed: Jan. 25, 1996

[30] Foreign Application Priority Data

Jan. 30, 1995 [GB] United Kingdom ..... 9501729

[51] Int. Cl.[6] ..... B41F 31/00

[52] U.S. Cl. ..... 101/491; 101/335; 400/106; 400/107

[58] Field of Search ..... 101/336, 337, 101/348, 491, 335; 106/20 R, 21 R, 20 D; 400/103, 106, 107

[56] References Cited

U.S. PATENT DOCUMENTS

| | | | |
|---|---|---|---|
| 3,599,229 | 8/1971 | Merrell | 400/106 |
| 4,739,377 | 4/1988 | Allen | 400/106 |
| 4,864,618 | 9/1989 | Wright . | |
| 5,408,416 | 4/1995 | Gilham | 101/71 |
| 5,440,979 | 8/1995 | Bonham et al. | 101/91 |

*Primary Examiner*—John S. Hilten
*Attorney, Agent, or Firm*—Shoemaker and Mattare Ltd.

[57] ABSTRACT

A method of identifying a franking machine used to print franking impressions is disclosed. Ink used by the franking machine contains a chemical tag unique to each franking machine, or to a group of franking machines, and the impression printed by the franking machine is sensed to determine the identity of the tag and hence to determine the identity of the franking machine used to print the impression.

13 Claims, 3 Drawing Sheets

FRANKING MACHINE AND METHOD OF IDENTIFYING FRANKING MACHINE

BACKGROUND OF THE INVENTION

This invention relates to systems for printing franking impressions on mail and other items to indicate that a charge for handling the item has been accounted for.

Franking machines for franking items of mail by printing an authorised franking impression on the mail item are well known. In such machines the impression printed comprises an invariable pattern determined by the postal authority together with a variable part which indicates data variables such as a postage charge for the item and the date on which the impression is printed. The invariable pattern usually includes data identifying the franking machine and the postal office responsible for receiving mail items franked by that machine.

It will be appreciated that the printing of a franking impression on a mail item represents a charge for handling that item and hence it is necessary that proper accounting is carried out in respect of printing of such franking impressions. From the point of view of the postal authority, revenue from postage charges in respect of franked mail items is determined by the accounting carried out in respect of printing of franking impressions on mail items. Accordingly the postal authority needs to be assured that the accounting is properly and exactly carried out so that the postal authority can ensure that the correct revenue is received for mail items handled by the postal authority. Similarly the user of a franking machine needs to be assured that the charges paid to the postal authority are correct in respect of the franked items of mail.

There is a possibility of franking mail items fraudulently with a franking machine and the postal authorities require manufacturers of franking machines to take such steps as may be necessary to eliminate or at least reduce to an acceptable minimum the risk of fraudulent use of franking machines. Accordingly such machines are constructed in a secure manner with those parts of the machine concerned with carrying out accounting functions and setting of a postage charge value to be printed being housed in a sealed secure housing to which access by authorised personnel only is permitted and evidence of any unauthorised access is provided for example by breaking of a seal.

However while fraudulent use of franking machines can be reduced or eliminated by appropriate construction of the machine a further possibility of fraud on the postal authority is the use of copying machines capable of printing in a colour, corresponding to that of inks used in franking machines, to print copies of a single franking impression printed by a franking machine. With the common availability of copying machines capable of producing copies of franking impressions which are difficult to distinguish from genuine franking impressions printed by franking machines this is of major concern to postal authorities.

SUMMARY OF THE INVENTION

According to one aspect of the invention a franking machine includes printing means for printing franking impressions on mail items and ink supply means to supply ink to said printing means; said ink including a chemical tag identifying said ink whereby the franking machine can be identified by the presence of said chemical tag in the printed franking impression.

According to a second aspect of the invention a method of identifying a franking machine utilised to print a franking impression includes the steps of including a chemical tag in ink used to print the franking impression, said tag being unique to said franking machine; and reading the printed franking impression to identify the chemical tag in the printed franking impression and thereby identify the franking machine.

According to a third aspect of the invention a method of identifying a group of franking machines of which group a franking machine is utilised to print a franking impression includes the steps of including a chemical tag in ink used to print the franking impression, said tag being unique to said group of franking machines; and reading the printed franking impression to identify the chemical tag in the printed franking impression and thereby identify the group of which the franking machine is a part.

BRIEF DESCRIPTION OF THE DRAWING

An embodiment of the invention will now be described by way of example with reference to the drawings in which.

DESCRIPTION OF THE PREFERRED EMBODIMENT

Figure 1:
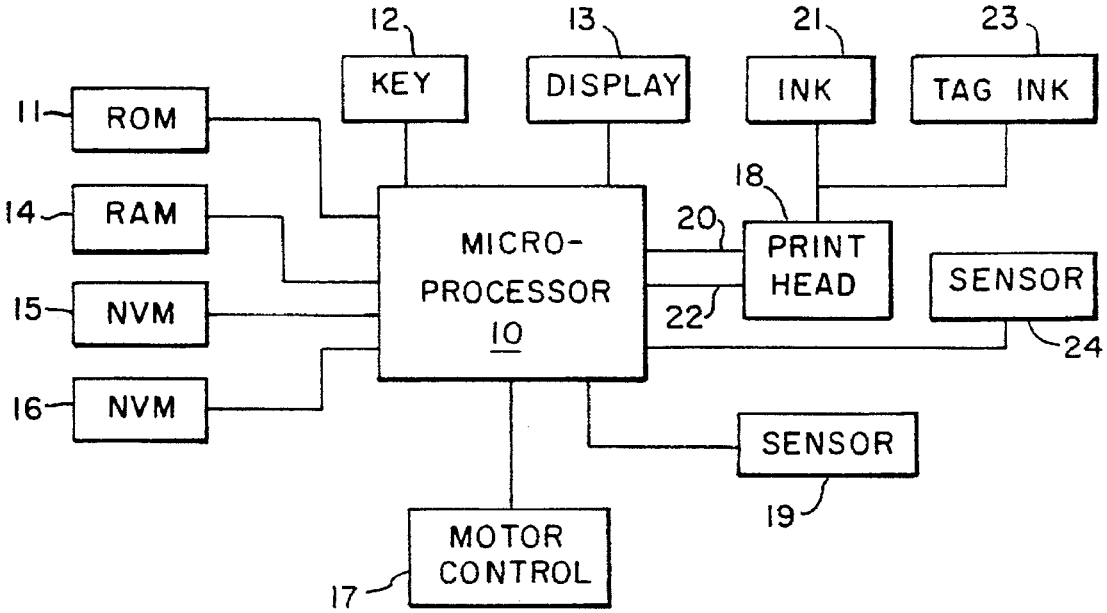
FIG. 1 shows diagrammatically a franking machine in accordance with the invention.

Referring to the drawing a franking machine includes a micro-processor 10 operating under program routines stored in a read only memory (ROM) 11. A keyboard 12 is provided for input of data by a user and a display 13 is provided to enable display of information to the user. A random access memory (RAM) 14 acts as a working store for storage of temporary data during operation of the franking machine. Non-volatile duplicated memories 15, 16 store data which is required to be retained even when the franking machine is not powered. Accounting data relating to use of the franking machine for printing franking impressions representing postage charges for mail items and any other critical data to be retained is stored in the non-volatile memories 15, 16. A motor controller 17 is controlled by the microprocessor to control operation of motors for driving feed means (not shown) for feeding mail items past a print head 18. A sensor 19 is provided to sense the presence of a mail item. The sensor 19 provides signals to the 15 microprocessor to enable the microprocessor to initiate operation of the machine to print a franking impression. The print head 18 may be a print drum carrying a fixed print die for printing an invariable pattern and print wheels to print variable data. One set of print wheels is provided to print the current date and second set of print wheels print the value of postage charge. The print wheels are set to the required value by signals from the microprocessor on line 20. When a mail item is present, as determined by sensor 19, and it is desired to print a franking impression on that item the microprocessor outputs a trip signal on line 22 to cause rotation of the print drum such as to print the franking impression. As is well known those parts of the franking machine concerned with carrying out accounting and control functions in relation to franking of mail items are housed in a secure housing to prevent unauthorised access thereto. The general construction and operation of franking machines is well known and accordingly it is believed to be unnecessary to describe the franking machine in further detail.

Ink for printing the franking impression is supplied from an ink supply 21 to the print head. The ink supply may be an inked roller with which the print die and print wheels carried by the print drum engage during rotation of the print drum prior to engagement of the print die and print wheels with the mail item.

Generally the same formulation of ink is used in all franking machines of any given manufacturer or in all those machines having an ink supply, for example ink roller, supplied by a given ink supply manufacturer and hence franking impressions cannot be identified as having been printed by a specific franking machine.

However in accordance with the invention the ink supply of the franking machine contains ink which is chemically tagged whereby not only can a genuine franking impression on a mail item be identified as a genuine impression but also if desired the franking machine utilised to print the impression can be identified.

Figure 2:
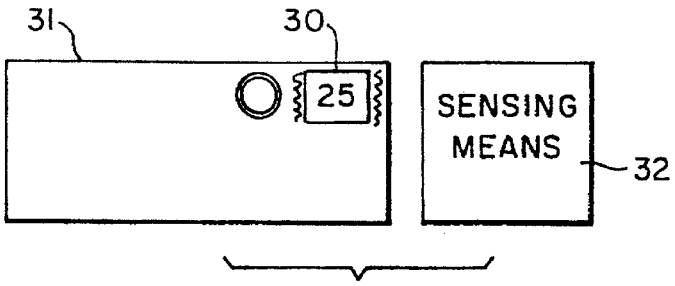
FIG. 2 illustrates sensing means for sensing ink used to print a franking impression.

In order to enable identification of the franking machine which printed any selected franking impression the ink, in the ink supply 21 which is supplied to the printing elements of the print head, contains a chemical which has been reacted in such a manner as to produce a unique chemical tag for that specific franking machine. The chemical may be one in which hydrogen has been replaced by deuterium and then reacted in order to produce a unique chemical tag for admixing with the ink. Such a chemical tag may provide billions of unique tags or markers. The concentration of the altered chemical may be as low as parts per billion or less. The ink containing the chemical tag may be "read" by mass spectroscopy or gas chromatography. Accordingly if a franking impression 30 printed on a mail item 31 is "read", by sensing means 32 (see FIG. 2), to identify the chemical tag the franking machine to which that specific ink was supplied and used to print the franking impression can be identified. Typically the sensing means 32 would be located at a postal authority depot. It will be appreciated that if "reading" any franking impression by the sensing means 32 does not reveal an authorised chemical tag the franking impression is shown to have been printed in an unauthorised manner and steps can be taken to reject the mail item 31 from further handling by the postal authority.

Figure 3:
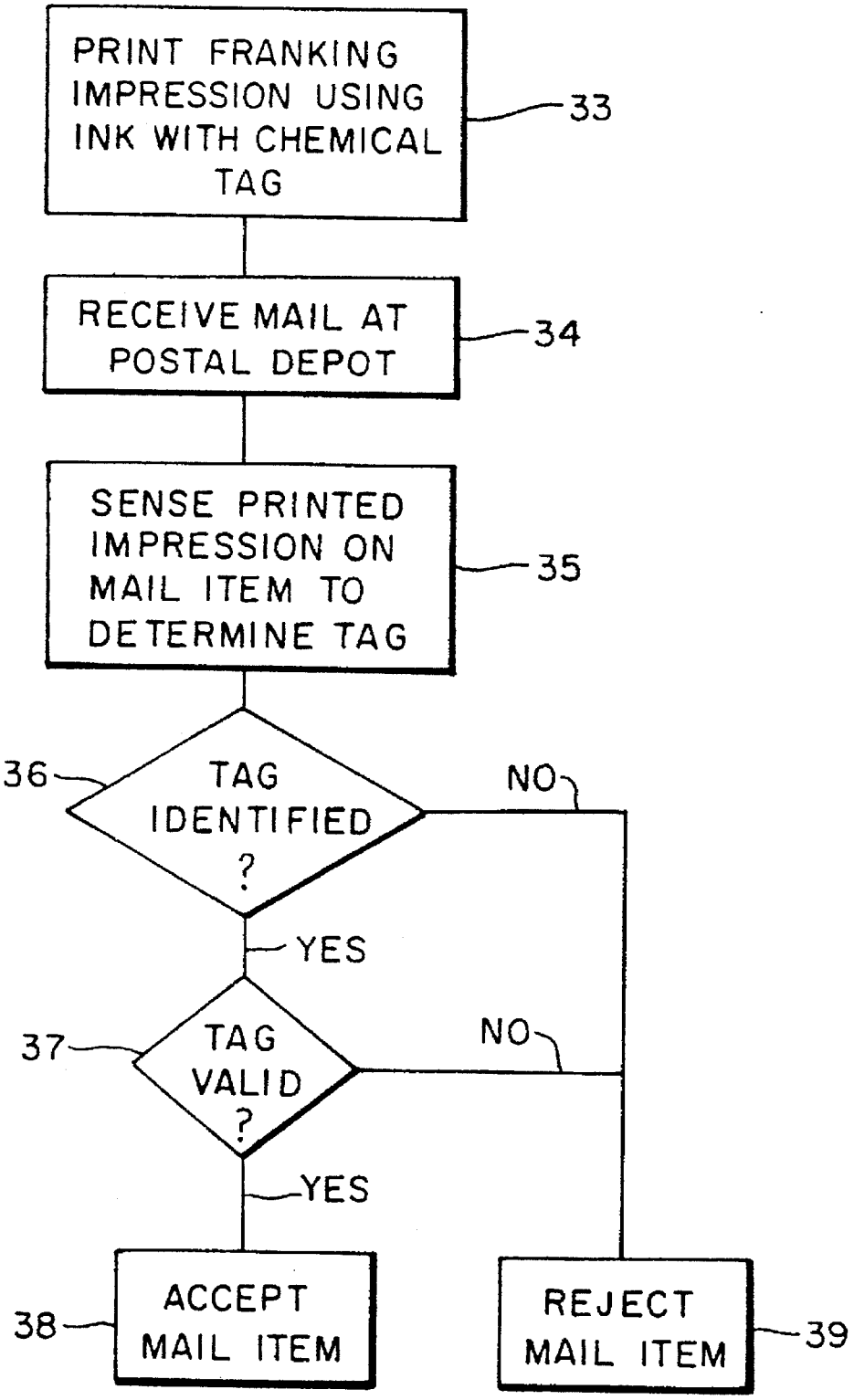
FIG. 3 is flow chart illustrating steps in printing a franking impression and determining identity of a franking machine used to print the franking impression.

The sequence of steps of printing a franking impression and sensing the ink if the printed impression to determine identity of the franking machine used to print the impression is illustrated in the flow chart of FIG. 3. The franking machine uses ink containing a chemical tag unique to that franking machine to print (box 33) the franking impression 30 on the mail item 31. The mail is received (box 34) at a postal authority depot for delivery to a destination. The postal authority utilises the sensing means 32 to sense (box 35) the ink with which the franking impression 30 has been printed and to determine (box 36) the chemical tag contained in the ink. If the chemical tag is identified (YES output of box 36), the sensing means determines (box 37) if the identified chemical tag has been issued in respect of a franking machine and hence if it is a valid tag. If the tag is valid, the mail item is accepted for handling (box 38). However if the chemical tag is not identified (NO output of box 36) or the tag is not valid (NO output of box 37) the mail item is rejected (box 39). If desired, the identity of the franking machine in respect of which the identified tag has been issued may be determined (box 38).

As described hereinbefore, the chemical tag is unique to a specific franking machine but if desired the tag may be unique for a group of franking machines, for example franking machines operated by a single user, franking machines operated in a specific postal region, franking machines manufactured or supplied by a specific manufacturer or supplier or any other desired group of franking machines.

Figure 4:
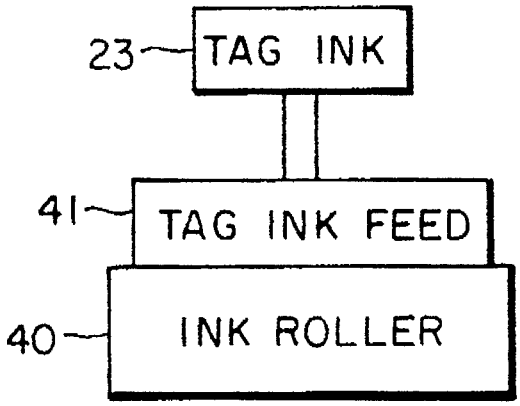
FIG. 4 illustrates diagrammatically means for supplying ink containing a chemical tag to an inking roller.
Figure 5:
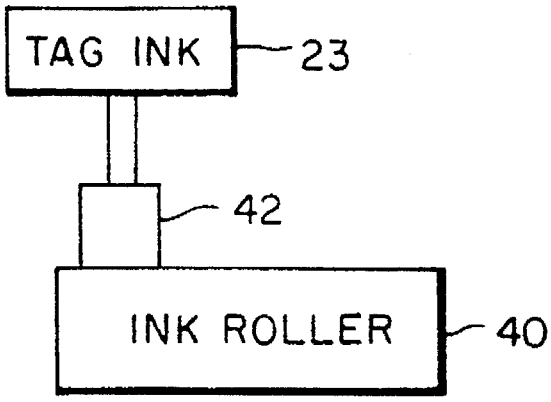
FIG. 5 is similar to FIG. 4 illustrating supplying ink containing a chemical tag to a band of the inking roller.

The ink supply for franking machines needs to be replenished relatively frequently particularly when there is high volume use of the franking machine. Accordingly where it is desired to provide unique identification of each franking machine the logistics of providing a replenishment supply of ink which is unique for each machine may be unacceptably expensive. In order to reduce the cost the franking machine may be provided with a normal unspecific ink supply 21 and a tagged ink supply 23 as shown in the drawing. The ink supply 21 supplies the major part by volume of ink required for printing the franking impression and is replaceable as in known franking machines. The tagged ink supply 23 is fitted at the time of manufacture of the franking machine and supplies tagged ink to be mixed in a very low proportion with the ink from the ink supply 21. Thus the mixed ink supplied to the print head contains a very small proportion of the chemical tag. Where the ink supply 21 is an inked roller 40 (see FIGS 4 and 5), the tagged ink may be fed from a supply 23 to the roller 40 by a drip or capillary feed 41 during use of the machine. The tagged ink may be mixed generally with the normal ink as illustrated in FIG. 4 so that the chemical tag is present throughout the extent of the franking impression. Alternatively as illustrated the tagged ink from the supply 23 may be mixed with the normal ink to a limited extent by means 42 so that a band of the printed impression contains the chemical tag.

An ink level sensor 24 is provided to detect that tagged ink is present in the machine, signals from the sensor 24 being provided to the microprocessor 10. The microprocessor is programmed to monitor the sensor 24 and to permit a franking operation to be carried out only if the sensor 24 indicates that tagged ink is present in the supply 23.

Since only a relatively small amount of tagged ink is used as compared with normal ink, the tagged ink supply requires relatively infrequent replenishment and hence the logistics of ensuring a supply of tagged ink for each franking machine or group of machines, the tagged ink being unique to a specific franking machine or specific group of franking machines, are simplified and less costly and for example replenishment of the unique tagged ink may be carried out as part of a periodical service routine by a service engineer.

I claim:

1. A franking machine including printing means; control means operable to operate the printing means to print a franking impression on a mail item, said franking impression including postage information; ink supply means to supply ink to said printing means; said ink supply means supplying ink including a unique chemical tag selected from a plurality of different chemical tags, the selected unique chemical tag being unique to said ink supplied by said ink supply means and effective to identify said ink supplied by said ink supply means to said printing means and thereby a franking impression printed by said printing means with said ink including the unique selected chemical tag is uniquely identified as a franking impression printed by said printing means of said franking machine.

2. A franking machine as claimed in claim 1 wherein the ink supply means includes first means to supply first ink absent any of the plurality of chemical tags to the printing means and second means to supply second ink including the selected unique chemical tag to the printing means.

3. A franking machine as claimed in claim 2 including sensing means responsive to the second means to supply the second ink and wherein the control means is operative to operate the printing means only in response to said sensing means detecting presence of said second ink in said second means.

4. A franking machine as claimed in claim 2 including combining means operative to mix the second ink with the first ink to distribute the selected unique chemical tag throughout the first ink supplied to the printing means and thereby to distribute said selected unique chemical tag throughout the printed franking impression.

5. A franking machine as claimed in claim 2 including combining means operative to mix to a limited extent the second ink with the first ink to distribute the selected unique chemical tag only in a portion of first ink utilised by the printing means to print a band of the franking impression.

6. A method of identifying a franking machine utilised to print a franking impression on a mail item including the steps of selecting a unique chemical tag from a plurality of different chemical tags; including the selected unique chemical tag in ink; supplying said ink containing said selected unique chemical tag to printing means of the franking means utilised to print the franking impression; operating the printing means to print the franking impression on the mail item with said ink containing said selected unique chemical tag; and reading the printed franking impression printed on the mail item to identify the unique chemical tag in the ink of the printed franking impression and utilising the identification of the unique chemical tag to identify the franking machine utilised to print the franking impression.

7. A method of identifying a group of franking machines utilised to print franking impressions on mail items including the steps of selecting a unique chemical tag from a plurality of uniquely different chemical tags; including the selected unique chemical tag in ink used by printing means of said group of franking machines to print a franking impression, said chemical tag being unique to said group of franking machines; operating printing means of one franking machine of said group of franking machines to print the franking impression on one mail item; and reading the printed franking impression on said one mail item to determine the selected unique chemical tag in the printed franking impression on said one mail item and utilising the determination of the unique chemical tag to identify the group in which said one franking machine is included.

8. A method as claimed in claim 7 in which the franking impression is printed using a combination of first ink absent any chemical tag of the plurality of uniquely different chemical tags and a second ink containing the selected unique chemical tag.

9. A method as claimed in claim 8 including the step of combining the second ink with the first ink as the first ink is supplied to the printing means of the franking machine.

10. A method as claimed in claim 8 wherein the second ink is supplied to the printing means of the franking machine such that the selected unique chemical tag is contained in a band of the printed franking impression.

11. A method as claimed in claim 7 in which the franking impression is printed with a first ink absent any chemical tag of the plurality of unique chemical tags and a second ink containing the selected unique chemical tag.

12. A method as claimed in claim 11 including the step of combining the second ink to the first ink as the first ink is supplied to the printing means of the franking machine.

13. A method as claimed in claim 11 wherein the second ink is supplied to printing means of the franking machine such that the selected unique chemical tag is contained in a band of the printed franking impression.

* * * * *